US005103911A

United States Patent [19]

Heijnen

[11] Patent Number: 5,103,911

[45] Date of Patent: Apr. 14, 1992

[54] METHOD AND APPARATUS FOR PERFORATING A WELL LINER AND FOR FRACTURING A SURROUNDING FORMATION

[75] Inventor: Wilhelmus H. P. M. Heijnen, Assen, Netherlands

[73] Assignee: Shell Oil Company, Houston, Tex.

[21] Appl. No.: 650,830

[22] Filed: Feb. 5, 1991

[30] Foreign Application Priority Data

Dec. 2, 1990 [GB] United Kingdom ..... 9003091

[51] Int. Cl.[5] ..... E21B 43/26

[52] U.S. Cl. ..... 166/297; 166/308; 166/376; 175/4.52

[58] Field of Search ..... 166/297, 298, 308, 55, 166/191, 185, 317, 376; 175/4.52

[56] References Cited

U.S. PATENT DOCUMENTS 2,436,198 2/1948 Cardwell et al. ..... 166/376 X
3,106,959 10/1963 Huitt et al. ..... 166/376 X
3,361,204 1/1968 Howard et al. ..... 175/4.52 X
3,417,827 12/1968 Smith et al. ..... 175/4.52 X
3,602,308 8/1971 Vincent ..... 166/3.8 X
4,669,539 6/1987 Barrington ..... 166/120
4,673,039 6/1987 Mohaupt ..... 166/281

FOREIGN PATENT DOCUMENTS

0250106A2 12/1987 European Pat. Off. .

*Primary Examiner*—William P. Neuder

[57] ABSTRACT

A liner at the bottom of an oil or gas well is perforated and the surrounding formation is subsequently fractured by inserting into the liner a perforating and fracturing apparatus comprising a pair of packers that can be positioned around fragile spots of the liner, and subsequently injecting a fluid or fluids at an elevated pressure into the area between the packers in order to perforate the liner at the locations of the fragile spots and to create fractures in the formation surrounding these spots.

11 Claims, 2 Drawing Sheets

METHOD AND APPARATUS FOR PERFORATING A WELL LINER AND FOR FRACTURING A SURROUNDING FORMATION

FIELD OF THE INVENTION

The invention relates to a method and apparatus for perforating a liner of an oil or gas production well and for subsequently fracturing an underground formation surrounding the liner.

BACKGROUND OF THE INVENTION

In may well completion operations it is not possible to install a slotted liner at the well intake. In those situations it is common practice to install an unslotted liner in the well, and subsequently perforating the liner using a perforation gun. Such a gun contains a mass of explosives which shoot perforations through fragile spots of the liner. After retrieval of the gun from the well the formation surrounding the perforation may be fractured by pumping a fluid at an elevated pressure through the perforations into the formation.

The conventional perforating and fracturing procedures are time consuming. They also involve the risk that during or after the shooting of perforations well fluids enter the reservoir formation thereby causing formation impairment.

It is an object of the present invention to provide a method and apparatus for perforating a well liner and subsequently fracturing an underground formation surrounding this liner which remedy the above-mentioned drawbacks of the conventional perforation and fracturing procedures.

SUMMARY OF THE INVENTION

The method according to the invention comprises: inserting into a well a liner having along at least a selected interval of its length a series of fragile spots; lowering through the liner a perforating and fracturing tool comprising a pipe string which carries at its outer surface a pair of packers and which has at least one port in the area between the packers, the pipe being equipped near its lower end with a bottom valve for closing off the pipe interior at a location below the packers; positioning the tool in the liner such that the packers span at lest one of said spots; closing the bottom valve; spotting a fluid via the pipe and the ports into an annular space around the pipe and between the packers, thereby perforating each fragile spot of the liner around said annular space; injecting fluid at an elevated pressure into the pipe, thereby actuating the packers to form fluid tight seals adjacent said annular space and creating fractures in the formation surrounding each perforated spot; and reducing the fluid pressure in the pipe, annular space and fractures.

The apparatus according to the invention comprises: a pipe string which can be lowered through the well liner; a pair of packers being mounted at a selected mutual distance on the outer surface of the pipe; at least one port formed in the pipe wall in the area between the packers; and a bottom valve being arranged near a lower end of the pipe for closing off the pipe interior below the packers.

DETAILED DESCRIPTION OF THE INVENTION

Figure 1:
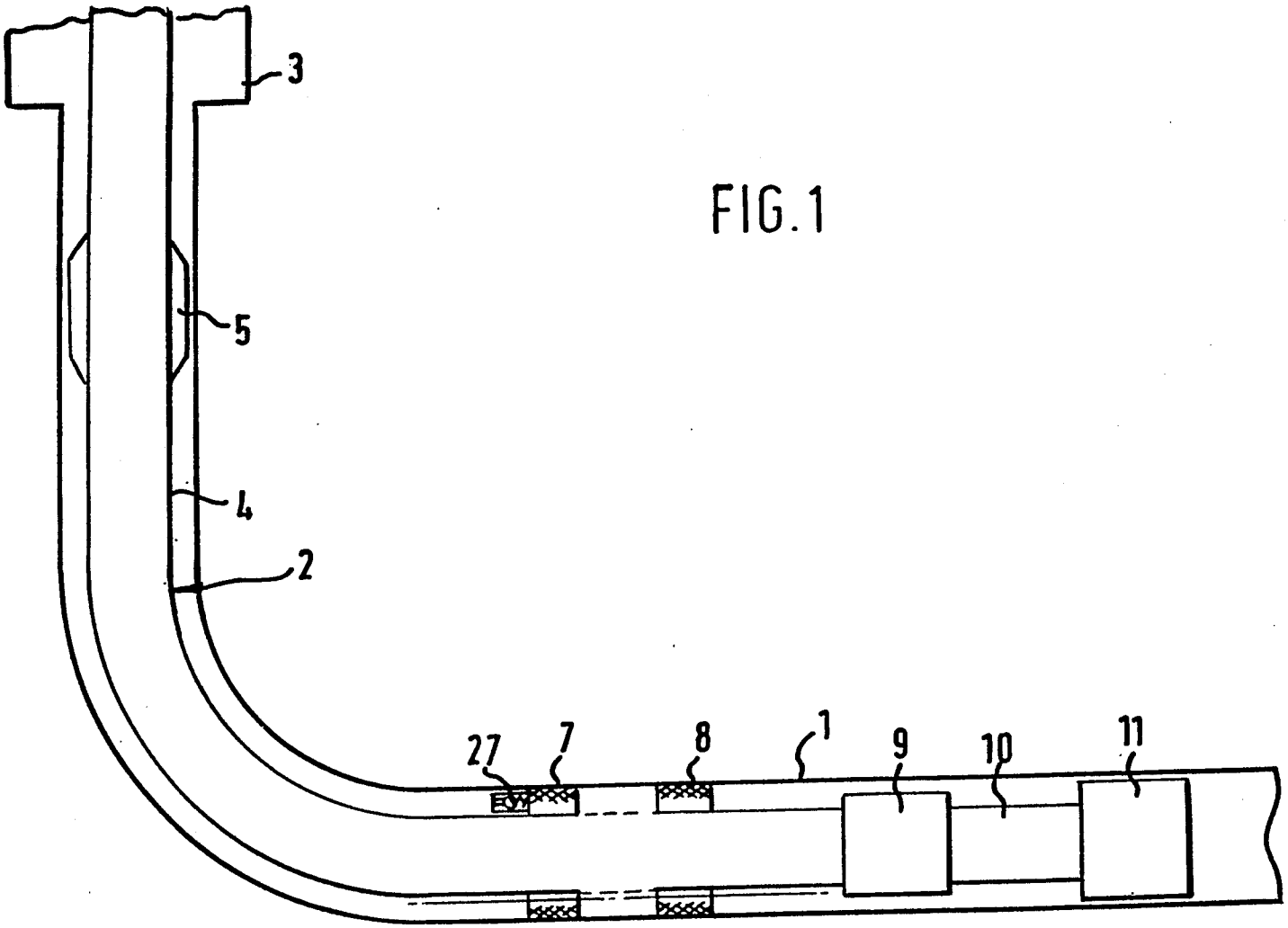
FIG. 1 is a longitudinal view of a well in which an apparatus according to the invention is located.

Referring now to FIG. 1 there is shown a well with a horizontal lower section in which a well liner 1 is arranged. The well extends from the earth surface into an oil and/or gas containing reservoir formation which surrounds the liner 1.

A perforating and fracturing tool 2 has been lowered into the well through a blow out preventer at the well head 3. The tool 2 comprises an elongate pipe 4 which is equipped with bell nipple 5 for a production safety valve, two packers 7, 8, and a bottom valve 9, and a latching sub 10 which carries a hydraulically actuated packing plug 11.

Figure 2:
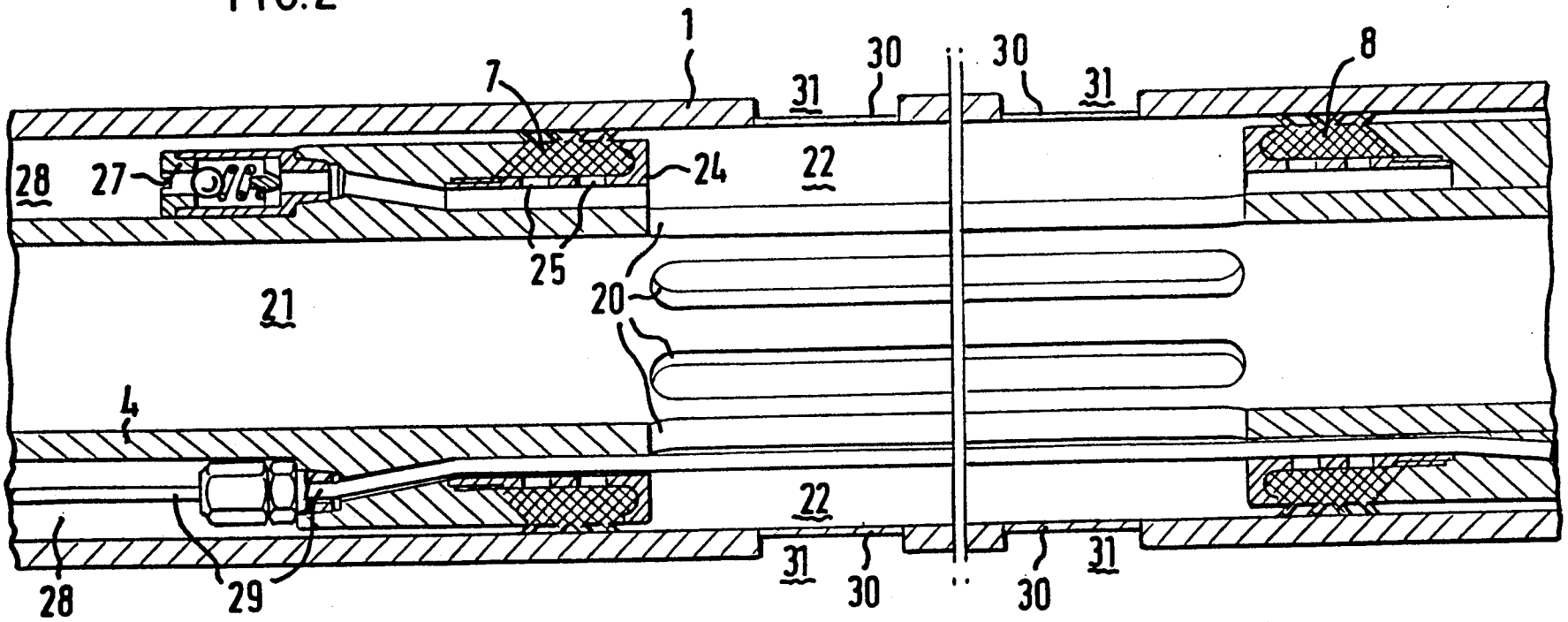
FIG. 2 shows in larger detail a section of the well and of the tool shown in FIG. 1.

As shown in FIG. 2 the pipe 4 contains ports 20 in the area between the packers 7 and 8. The ports 20 create fluid communication between the pipe interior 21 and an annular space 22 between the pipe 4 and the liner 1 in the area between the packers 7 and 8. The packers 7 and 8 are secured to the pipe by clamp rings 24 in which openings 25 are arranged via which the pressure within the annular space 22 may enter the inner surface of the elastomeric sliding or fixed packers 7 and 8 so as to inflate the packers to form fluid tight seals in response to pressurizing the pipe interior 21.

A one way valve 27 is mounted near the uppermost packer 7 for enabling fluid to flow from the annulus 28 between the liner 1 and the section of the pipe above the packer 7 into the annular space 22. A hydraulic conduit 29 for actuating the bottom vale 9 passes through the annulus 28, the annular space 22, and the pipe wall underneath the packers 7 and 8.

In the context of this specification "lower" parts of the well and the tool are parts having a larger distance to the wellhead, when measured along the well path than "upper" parts of the well and the tool. Accordingly the uppermost packer 7 is located closer to the wellhead 3 than the lowermost packer 8.

The liner 1 consists of a steel tubular body in which a series of fragile spots 30 are present throughout its length. In the embodiment shown the spots 30 are created by machining cup-shaped recesses 31 at regular intervals into the outer surface of the body. If desired the fragile spots 30 may be formed by aluminum or other acid soluble inserts (not shown) which can perform as shear discs and which can be dissolved by an acid.

The normal operation of the apparatus is as follows. Before running the apparatus into the well the liner 1 has been cleaned up, tagged, and gauged and the well has been filled with a non-water based liquid.

The tool is then lowered into the well until the packing plug 11 has reached the bottom of the well. The tool may then be pulled to position the packers 7 and 8 such that they span at least one of the fragile spots 30. Then the bottom valve 9 is closed. If the fragile spots 30 consist of acid soluble discs they can be dissolved by lowering a coiled tubing through the interior of the pipe 4 via which acid is spotted into the pipe interior and the annular space 22 between the packers 7 and 8 in order to dissolve the discs. After spotting the acid fluid in injected at elevated pressure into the pipe interior 21. The resulting positive pressure difference between the annular space 22 between the packers 7 and 8 and the other annuli around the pipe 4 will cause the packers to expand and to form fluid tight seals against the inner surface of the liner. At the same time a positive pressure difference is created between the annular space 22 and the pores of the surrounding reservoir formation. This causes the remaining parts of the possibly only partly dissolved discs to be sheared and fractures to be formed in the formation around the sheared discs in the area between the packers 7 and 8.

The fluid which is injected at elevated pressure via the pipe interior 21 into the fractures may contain an acid in order to etch channels in the formation and/or a propping agent, such as sand, for forming a permanently permeable core inside the fractured channels.

After this the pressure in the pipe interior 21 and annular space 22 is reduced which causes the packers 7 and 8 to be released from the wall of the liner 1 and at lest part of the fracturing fluid and propping agent to be produced back into the well. As the returned fracturing fluid, which may contain formation particles, and the returned propping agent may contaminate the well interior they are preferably subsequently flushed away by pumping a cleaning fluid at an elevated pressure into the annulus 28 which causes the one way valve 27 to open and cleaning liquid to circulate down through the annulus 28, one way valve 27 into the annular space 22 and subsequently up via the ports 20 and the pipe interior 21.

At this moment a production test can be carried out after which a decision can be made to fracture again, to leave it as it is, to further etch channels by acidizing or to close the created fractures by pumping cement into the created fractures.

Then the tool 2 is pulled until the packers span other fragile spots 30 than the already removed spots and the cycle of spotting acid to dissolve the discs, elevating the pressure in the pipe interior 21 and annular space 22 so as to fracture the formation, reducing the pressure again, and optionally injecting propping agent into the fractures and flushing a cleaning fluid through the well is repeated again one or more times until the whole interval of the liner where fragile spots are present has been perforated.

It will be appreciated that the procedure according to the invention enables perforating a small section of the liner and subsequently fracturing the formation surrounding this section of the liner. This procedure of perforating the liner section by section enables an accurate control of the fracturing process which is particularly important of the liner has a large length, which is usually the case in a horizontal or nearly horizontal well.

After the required number of liner perforations and formation fractures has been made the pipe is pulled up through the well and the temporary packing plug 11 is set at the top of the perforated liner by actuating the latching sub 10. Then the pipe 4 is removed from the well.

The well can now be completed with a permanent packer and production tubing, whereupon the well may be circulated to nitrogen to allow the temporary packer to open and to allow oil and/or gas to flow through the perforated liner and fractures in the surrounding formation.

I claim:

1. A method for perforating a well liner and subsequently fracturing an underground formation surrounding the liner, the method comprising:

inserting into a well a liner having along at least a selected interval of its length a series of fragile spots;

lowering through the liner a perforating and fracturing tool comprising a pipe string which carries at its outer surface a pair of packers and which has at least one port in the area between the packers, the pipe being equipped near its lower end with a bottom valve for closing off the pipe interior at a location below the packers;

positioning the tool in the liner such that the packers span at least one of said spots;

closing the bottom valve;

spotting a fluid via the pipe and the ports into an annular space around the pipe and between the packers, thereby perforating each fragile spot o the liner around said annular space;

injecting fluid at an elevated pressure into the pipe, thereby actuating the packers to form fluid tight seals adjacent said annular space and creating fractures in the formation surrounding each perforated spot; and reducing the fluid pressure in the pipe, annular space and fractures.

2. The method of claim 1 wherein the liner comprises a tubular steel body and said fragile spots consist of acid soluble discs that are inserted in openings in the wall of said tubular body, and wherein the step of spotting said fluid comprises injecting an acid into said annular space which dissolves said acid soluble disc or discs around said annular space.

3. The method of claim 1 wherein the fragile spots consist of shear discs that are formed by machining cup-shaped recesses in the wall of the liner and wherein the step of spotting aid fluid comprises injecting liquid at an elevated pressure into the pipe, thereby actuating the packers to form fluid tight seals adjacent said annular space and shearing the discs in the region of the liner between the packers.

4. The method of claim 3 wherein the step of injecting liquid at an elevated pressure into the pipe for shearing the disc and the step of injecting fluid at an elevated pressure into the pipe to create fractures in the formation are carried out in a single portion by continuously injecting a fracturing liquid at high pressure into the pipe string thereby successively shearing the discs and fracturing the formation.

5. The method of claim 1 wherein after fracturing the formation a propping agent is injected via the pipe and annular space into the fractures.

6. The method of claim 5 wherein a one way valve is located near the uppermost packer, which valve allows fluid to flow from an annulus between the liner and the section of the pipe above the uppermost packer and the annular space between the packers, and wherein after reducing the fluid pressure in the pipe, annular space, and the fractures a cleaning liquid is circulated down via the annulus, one way valve, and annular space, and subsequently up through the pipe to remove any propping agent from the well interior.

7. The method of claim 1 wherein after the step of lowering the tool through the liner and before removing the tool from the well the cycle of steps of positioning the tool in the liner, closing the bottom valve, spotting the fluid and injecting fluid at elevated pressure and reducing the pressure is repeated, while between subsequent cycles the tool is moved through the well such that during each cycle the packers span other spots of the liner than any already perforated spots.

8. The method of claim 7 wherein each cycle further includes the steps of injecting said propping agent into the fractures and subsequently circulating said cleaning fluid to remove any propping agent from the well.

9. The method of claim 5 wherein the interval of the liner having said fragile spots is located in an at lest nearly horizontal section of an oil production well.

10. An apparatus for perforating a well liner and subsequently fracturing an underground formation surrounding the liner, comprising:

a pipe string which can be lowered through the well liner;

a pair of packers being mounted at a selected mutual distance on the outer surface of the pipe;

at least one port formed in the pipe wall in the area between the packers; and a bottom valve being arranged near a lower end of the pipe for closing off the pipe interior below the packers wherein a hydraulically actuated packing plug is releasably connected to the lower end of the pipe by means of a hydraulically operated latching sub.

11. An apparatus for perforating a well liner and subsequently fracturing an underground formation surrounding the liner, comprising:

a pipe string which can be lowered through the well liner;

an uppermost and lowermost packer being mounted at a selected mutual distance on the outer surface of the pipe wherein an uppermost packer is equipped with a one way valve, which valve allows in-use fluid to flow from an annulus between the liner and the section of the pipe above the uppermost packer and an annulus space between the liner and the pipe section between the packers;

at lest one port formed in the pipe wall in the area between the packers; and a bottom valve being arranged near a lower end of the pipe for closing off the pipe interior below the packers.

* * * * *